US005597365A

United States Patent [19]

Yamada et al.

[11] Patent Number: 5,597,365

[45] Date of Patent: Jan. 28, 1997

[54] LIQUID CENTER THREAD WOUND GOLF BALL

[75] Inventors: Mikio Yamada, Kobe; Tadahiro Ebisuno, Nishinomiya; Keiji Moriyama; Kazushige Sugimoto, both of Akashi, all of Japan

[73] Assignee: Sumitomo Rubber Industries, Ltd., Hyogo-ken, Japan

[21] Appl. No.: 305,323

[22] Filed: Sep. 6, 1994

[30] Foreign Application Priority Data

Sep. 6, 1993 [JP] Japan ..... 5-220923

[51] Int. Cl.[6] ..... A63B 37/08

[52] U.S. Cl. ..... 473/354

[58] Field of Search ..... 273/231; 473/354, 473/357

[56] References Cited

U.S. PATENT DOCUMENTS 4,805,914 2/1989 Toland ..... 273/231

5,033,749 7/1991 Kakiuchi ..... 273/231 X

FOREIGN PATENT DOCUMENTS 483977 11/1937 United Kingdom .

645311 5/1948 United Kingdom .

229641 3/1990 United Kingdom .

*Primary Examiner*—George J. Marlo

*Attorney, Agent, or Firm*—Birch, Stewart, Kolasch & Birch

[57] ABSTRACT

Disclosed is a thread wound golf ball which includes a liquid center composed of a rubber bag containing a liquid, a rubber thread layer provided on the outside of the liquid center and a cover for covering the rubber thread layer, wherein the moment of inertia measured at 23° C. of the golf ball is 75 to 80 g·cm$^2$ and the rate of increase of a moment of inertia measured at −30° C. to that measured at 23° C. is within 2%.

9 Claims, 1 Drawing Sheet

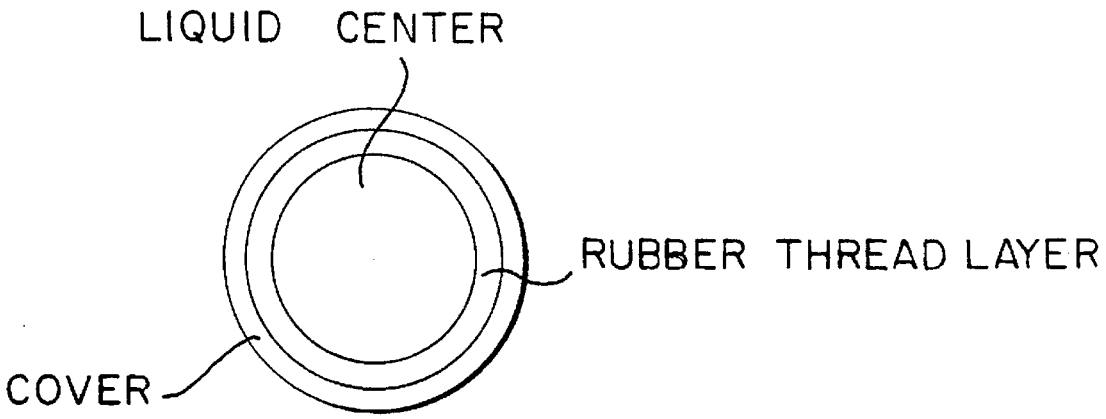
LIQUID CENTER
RUBBER THREAD LAYER
COVER

LIQUID CENTER THREAD WOUND GOLF BALL

FIELD OF THE INVENTION

The present invention relates to a thread wound golf ball having a liquid center which is composed of a rubber bag containing a liquid.

BACKGROUND OF THE INVENTION

In general, professional golfers or advanced golfers like a thread wound golf ball because of its high impact resilience, good hit feeling and excellent spin performances. However, it has hitherto been considered that the thread wound golf ball is not suitable for amateur golfers who require a long flying distance because the flying distance is inferior in comparison with a two-piece golf ball.

In the thread wound golf ball, since the amount of back spin put on the golf ball upon hitting is large, the lifting power is liable to act on the golf ball. In the process immediately after launching at which the velocity of the golf ball is high, the flying power and lifting power of the golf ball is strong and the golf ball launched at a low launching angle is blown up. The velocity of this golf ball is gradually reduced due to air pressure or resistance during flight. At this stage 2, the spinning ratio is reduced and the lifting force of the golf ball is reduced. Accordingly, the trajectory of the golf ball begins to go down rapidly as the lifting force and projectile force decrease. That is, the landing angle is large the rolling distance is small. This was the cause of its low flying distance in comparison with the two-piece golf ball.

In the ideal golf ball, the launch angle is high, the initial velocity is large, the amount of spin is small and a suitable lifting force acts on the golf ball. Therefore, the golf ball reaches the peak point gently without blowing up, and then begins to drop. It is preferred that the amount of spin is large (i.e. the lifting force is large) and the golf ball is not easily dropped at this time.

Heretofore, the weight has been concentrated in the center part to reduce the moment of inertia such that spin is easily put on the golf ball. The diameter of center of the golf ball is merely defined as 25 to 29 mm empirically, as described in "Rubber Industry Handbook". The moment of inertia is small and spin is easily put on the golf ball, and there is a limit in flying distance.

Therefore, a thread wound golf ball which can accomplish a long flying distance has hitherto been required. In this case, it was considered that the initial velocity of the golf ball can be increased by employing a rubber thread having high impact resilience. However, the initial velocity of the golf ball is defined by rules of U.S. Golf Association, and there is a limit in initial velocity.

Further, as described in Japanese Laid-Open Patent Publication 59-129072, there was suggested a trial of increasing the flying distance by decreasing the specific gravity of the center and, on the contrary, increasing the specific gravity of the cover to increase the moment of inertia. However, since an excessive amount of fillers are formulated in the cover material, stiffness of the cover itself becomes high, which results in a hard hit feeling, and it is not preferred. Although the moment of inertia is increased, there is a limit. Further, this technique is for the solid center. In order to reduce the amount of spin appropriately, a liquid center is employed. The liquid center has hitherto been employed for the balata cover golf ball on which spin is easily put. The liquid center itself exhibits no impact resilience but it follows deformation of the golf ball upon hitting. The deformation force applied to the rubber thread around the center thereby affords a restoring force to a rubber thread having high impact resilience.

In Japanese Laid-Open Patent Publication No. 60-92782, there is described that it is effective for decreasing the spin ratio of the golf ball to increase the diameter from the conventional diameter (25.4 to 26.99 mm) to 28.58 mm. Since the amount of spin of the golf ball with the balata cover is large, a trail has been done with respect to increasing the flying distance by controlling the amount of spin.

However, this technique merely discloses a change of the diameter of the center within a narrow range such as 25 to 29 mm. As to the diameter of the center, in Japanese Laid-Open Patent Publication No. 54-4626, there is described that the desirable diameter of the center is 25 to 29 mm. In Japanese Laid-Open Patent Publication Nos. 59-129072 and 48-4025, there is described that the desirable diameter of the center is 30 to 38 mm and 23 to 39 mm, respectively. In the "Rubber Industry Handbook" issued on 1973, page 864, column of golf ball, there is described that the outer diameter of the liquid center is 25 to 29 mm.

In Japanese Laid-Open Patent Publication No. 61-187875, there is suggested a golf ball comprising a liquid center having a specific gravity of 0.7 to 1.3 and a center cover having a specific gravity larger than that of the liquid center, the diameter of said liquid center being 25 to 34 mm. In this golf ball, a center cover has a large specific gravity in order to increase the moment of inertia. On the other hand, in Japanese Laid-Open Patent Publication No. 2-255162, there is suggested that the specific gravity of the center cover is decreased and, as a result, the golf ball becomes soft because the amount of the filler of the center cover is decreased, thereby affording large deformation of the center and a reduction of the amount of back spin on hitting to increase the flying distance.

However, the flying distance was not greatly increased in any golf ball.

SUMMARY OF THE INVENTION

Under these circumstances, the present inventors have studied intensively about a structure, material and flying performance, particularly the moment of inertia of the thread wound golf ball, and the present invention has been accomplished.

The main object of the present invention is to provide a rubber thread wound golf ball having ideal characteristics.

This object as well as other objects and advantages of the present invention will become apparent to those skilled in the art from the following description.

BRIEF DESCRIPTION OF THE DRAWINGS

The drawings illustrates the golf ball of the invention.

The present invention provides a rubber thread wound golf ball comprising a liquid center composed of a rubber bag containing a liquid, a rubber thread layer provided on the outside of the liquid center and a cover for covering the rubber thread layer, wherein a moment of inertia and a measured at 23° C. of the golf ball is 75 to 80 g·cm$^2$ and a rate of increase of a moment of inertia measured at −30° C. to that measured at 23° C. is within 2%.

That is, the present invention provides a golf ball with a liquid center which contributes to deformation of the ball as a liquid upon hitting the ball, and when the ball rotating by backspin after launching, contributes to the moment of inertia as a part of a golf ball, like the solid center. The golf ball thus has large moment of inertia and relatively little spin.

That is, the golf ball flies without blowing up during a period from the launching point to the peak point because of its structure and material wherein spin is not easily generated. During a period from the peak point to the landing point, damping of the spin is small because the moment of inertia is large. Therefore, the lifting force is comparatively large and the golf ball is not easily dropped, thereby increasing the flying distance. That is, the golf ball of the present invention is considered to be approximately an ideal golf ball.

When a liquid center is compared with a solid center, it is preferable to consider how much is contributed to moment of inertia. That is, regarding the solid center, no large change arises at a temperature from −30° C. to about room temperature. However, the liquid center is frozen at a temperature lower than the freezing point because of its water content. That is, it can take both solid and liquid forms by temperature.

When the content of the liquid center is a perfect liquid, it does not greatly contribute to the moment of inertia (the value of the moment of inertia is small) in the case of a spinning ball, and it contributes to the moment of inertia (the value of the moment of inertia is large) when it is in the frozen state. That is, the fact that the liquid state and frozen state are greatly distinct with regard to the moment of inertia means that the liquid center in a liquid state does not contribute to the moment of inertia under the condition of the temperature used for playing golf.

It is necessary for the golf ball that the moment of inertia be large within the range of the temperature for playing golf without increasing the specific gravity of the cover of the golf ball (i.e. without deteriorating hit feeling), as a matter of course. For this purpose, the center, in which the weight is concentrated, plays a significant role. In general, an air layer is partially present in the rubber thread layer because the rubber thread is not tightly wound in comparison with a solid golf ball (e.g. a one-piece golf ball as a mass of rubber or a two-piece golf ball prepared by coating the mass with the cover). Therefore, the specific gravity of this part is small in comparison with the solid golf ball and there is a limit to increase the specific gravity of the cover because the hit feeling is deteriorated. Therefore, it is necessary to make up the weight at the center part.

In order to improve flying performances substantially, it is necessary to use a liquid center on which spin is not easily put instead of a solid center on which spin is easily put. Besides, it is important that the moment of inertia at room temperature is large such that damping of spin becomes small.

In the golf ball which satisfies the above conditions, a moment of inertia measured at 23° C. is 75 to 80 g·cm$^2$, and a rate of increase of a moment of inertia measured at −30° C., at which the liquid center is frozen, to that measured at 23° C. is within 2%.

The moment of inertia can be measured by a normal measuring instrument. In the present invention, it is measured by a moment of inertia measuring instrument, model number 005-002, commercially available from Inertia Dynamics Inc. When the golf ball does not satisfy the above moment of inertia, excellent effect of the present invention is not obtained.

As the center solution contained in the liquid center of such a golf ball, for example, those comprising 100 parts by weight of water, 5 to 20 parts by weight of a freezing-point depressant (e.g. glycerin, ethylene glycol, etc.), 50 to 100 parts by weight of a filler (e.g. barium sulfate, etc.) and 10 to 30 parts by weight of a viscosity modifier (e.g. clay, etc.) are preferred. As a matter of course, any center solution may be used if the resulting golf ball satisfies the above performances, but the center solution mainly composed of water is substantially preferred.

As the rubber bag containing the center solution of the liquid center, there can be used those which have hitherto been used for the liquid center of the thread wound golf ball. For example, it can be formed by formulating 1 to 10 parts by weight of zinc oxide and 10 to 50 parts by weight of a filler (e.g. calcium carbonate, barium sulfate, etc.) in 100 parts by weight of natural rubber.

Pour of the center solution into the rubber bag can be conducted by a method which have hitherto been known. For example, there can be normally used a method of penetrating a needle in a rubber bag, a method comprising freezing a center solution in advance and then covering the frozen center solution with a rubber, a method of bonding two semi-spherical shell rubbers in a center solution, etc.

By winding a rubber thread for golf balls on the liquid center thus obtained, a thread wound center composed of a center and a rubber thread layer thereon is formed. The rubber thread is normally composed of a rubber component of natural rubber and synthetic isoprene rubber (mixing ratio is 75:25 to 25:75). As a matter of course, any one which has been used for the rubber thread for golf ball may be used.

The rubber thread thus obtained is covered with a cover mainly composed of an ionomer resin or balata (transpolyisoprene), and dimples are provided thereon to obtain a golf ball.

As described above, according to the present invention, there is provided a golf ball with a liquid center having large moment of inertia and little spin, which contributes to deformation of ball as liquid in case of hitting a ball, and when the ball rotating by backspin after launching, contributes itself to the moment of inertia as a part of the golf ball, like the solid center.

That is, the golf ball is flown without blowing up during a period from the launching point to the peak point because of its structure and material wherein spin is not easily put. During a period from the peak point to the landing point, damping of spin is little because the moment of inertia is large. Therefore, the lifting force is comparatively large and the golf ball is not easily dropped, thereby increasing the flying distance. That is, the golf ball of the present invention is considered to be approximately ideal golf ball.

EXAMPLES

The following Examples and Comparative Examples further illustrate the present invention in detail but are not to be construed to limit the scope thereof.

Examples 1 to 2 and Comparative Examples 1 to 2

After a liquid center shown in Table 1 was formed, the liquid center was coated with a center bag, followed by winding a normal rubber thread to form a rubber thread center. Then, the rubber thread center was coated with a cover resin shown in Table 1 to form a rubber thread wound golf ball.

TABLE 1

| | | | Example No. | | Comparative Example No. | |
|---|---|---|---|---|---|---|
| | | | 1 | 2 | 1 | 2 |
| Center | Center solution | Water | 100 | 100 | 100 | 100 |
| | | Glycerin | 13 | 13 | 17 | 5 |
| | | Barium sulfate | 80 | 85 | 155 | — |
| | | Clay | 17 | 13 | 22 | — |
| | Center bag | NR (natural rubber) | 100 | 100 | 100 | 100 |
| | | Zinc white | 5 | 5 | 5 | 75 |
| | | Calcium carbonate | 25 | 25 | 25 | 165 |
| | | Sulfur | 2 | 2 | 2 | 1 |
| | | Vulcanization accelerator | 3 | 3 | 3 | 2 |
| Cover resin | | Transpolyisoprene | 100 | 100 | 100 | 100 |
| | | NR (natural rubber) | 10 | 10 | 10 | 10 |
| | | Zinc white/titanium oxide | 5/15 | 5/15 | 5/15 | 5/15 |
| | | Sulfur/vulcanization accelerator | 1.5/ 1.5 | 1.5/ 1.5 | 1.5/ 1.5 | 1.5/ 1.5 |

Characteristics (e.g. specific gravity, and thickness, diameter and weight of the center cover) of the liquid centers of the resulting golf balls, the diameter of the thread wound cores of the thread wound centers, characteristics (e.g. weight, hardness, moment of inertia at 23° C., moment of inertia at −30° C. and rate of increase in moment of inertia) of the golf balls and the number of dimples are shown in Table 2. Further, characteristics (e.g. ball initial velocity, spin, carry and total) of the golf balls were measured by subjecting the resulting golf ball to a hitting test at a head speed of 45 m/second. The results are also shown in Table 2.

TABLE 2

| | | Example No. | | Comparative Example No. | |
|---|---|---|---|---|---|
| | | 1 | 2 | 1 | 2 |
| Characteristics of center | Specific gravity of center solution | 1.50 | 1.56 | 1.78 | 1.0 |
| | Thickness of center cover (mm) | 1.7 | 1.6 | 1.7 | 2.5 |
| | Specific gravity of center cover | 1.1 | 1.1 | 1.1 | 2.1 |
| | Diameter (mm) | 30.1 | 29.5 | 26.4 | 28.8 |
| | Weight (g) | 18.5 | 18.0 | 14.4 | 17.6 |
| Core | Diameter of thread wound core (inch) | 1.605 | 1.605 | 1.595 | 1.605 |
| Ball | Weight | 45.5 | 45.3 | 45.4 | 45.3 |
| | Hardness | Reasonable | Reasonable | Reasonable | Reasonable |
| | Moment of inertia at 23° C. | 76.9 | 76.7 | 74.5 | 74.7 |
| | Moment of inertia at −30° C. | 77.5 | 77.2 | 75.1 | 79.0 |
| | Rate of increase in moment of inertia | 0.8 | 0.7 | 0.7 | 5.7 |
| The number of dimple | | 400 | 432 | 360 | 392 |
| Measurement values at head speed of 45 m/second | Ball initial velocity (m/s) | 63.4 | 63.5 | 63.5 | 63.5 |
| | Spin (r.p.m.) | 3110 | 3105 | 3375 | 3360 |
| | Carry (yard) | 232.5 | 231.9 | 227.3 | 228.7 |
| | Total (yard) | 249.3 | 248.8 | 242.9 | 243.7 |

Regarding Comparative Example 1, a conventional liquid center is used and the diameter of the center is comparatively small and, further, the moment of inertia is small and the amount of spin is large. Therefore, the flying distance is not good in comparison with Examples 1 and 2.

Regarding Comparative Example 2, the liquid center containing a center solution having a specific gravity of 1.0 mainly composed of water is used and the diameter of the center is comparatively large and, further, the center cover has a comparatively large specific gravity so that the moment of inertia became large, but is not equal to the moment of inertia of Examples 1 and 2. Besides, there is a great difference in moment of inertia between the frozen state and the state at room temperature. That is, the golf ball of Comparative Example 2 has a large structural factor for increasing the moment of inertia, however, it is found that the center solution of this liquid center does not greatly contribute to the moment of inertia at the liquid state. Therefore, it is necessary to think out some device to obtain the moment of inertia which is the same as that of the center solution at the solid state (frozen state), even at room temperature.

In comparison with these Comparative Examples 1 and 2, Examples 1 and 2 plays a role in increasing the moment of inertia in view of structure and material of center solution and, therefore, spin is not easily put on the golf ball and the flying performances are excellent. That is, it is necessary that the specific gravity of the center solution is 1.3 to 1.6, the thickness of the center cover is 1.5 to 2.0 mm, the specific gravity of the center cover is 0.95 to 1.2 and the weight of the center is 17 to 20 g, preferably 18 to 19 g. Further, it is preferred that the diameter of the center is not 25 to 29 mm (conventional value) but not less than 29 mm (preferably 29.5 to 32 mm). The moment of inertia is not less than 75 $g \cdot cm^2$, preferably not less than 76 $g \cdot cm^2$. The above conditions make flying performances of the golf ball good.

In the golf ball of the present invention, the center solution is composed of 100 parts by weight of water, 5 to 20 parts by weight of glycerin or ethylene glycol, 50 to 100 parts by weight of barium sulfate and 10 to 30 parts by weight of clay. The center bag is composed of 100 parts by weight of natural rubber, 1 to 10 parts by weight of zinc oxide and 10 to 50 parts by weight of a filler (e.g. calcium carbonate, barium sulfate, etc.). The rubber thread is composed of natural rubber/isoprene rubber (75:25 to 25:75). The cover resin is composed of 100 parts by weight of transpolyisoprene resin, 3 to 20 parts by weight of natural rubber, 0 to 20 parts by weight of high-styrene resin, 2 to 15 parts by weight of zinc oxide and 5 to 25 parts by weight of titanium oxide.

What is claimed is:

1. A thread wound golf ball comprising a liquid center composed of a rubber bag containing a liquid, a rubber thread layer provided on the outside of the liquid center, and a cover for covering the rubber thread layer, wherein a moment of inertia measured at 23° C. of the golf ball is 75 to 80 $g \cdot m^2$, a rate of increase of a moment of inertia measured at −30° C. to that measured at 23° C. is within 2%, and the liquid contained in said rubber bag has a specific gravity of 1.3 to 1.6.

2. The thread wound golf ball according to claim 1, wherein the liquid center has a weight of 17 to 20 g.

3. The thread wound golf ball according to claim 1, wherein the rubber bag has an average thickness of 1.5 to 2.0 mm and a specific gravity of 0.95 to 1.2

4. The thread wound golf ball according to claim 1, wherein the liquid contained in said rubber bag comprises 100 parts by weight of water, 5 to 20 parts by weight of glycerin or ethylene glycol, 50 to 100 parts by weight of barium sulfate, and 10 to 30 parts by weight of clay.

5. The thread wound golf ball according to claim 1, wherein said rubber bag is prepared from a rubber composition comprising 100 parts by weight of natural rubber, 1 to 10 parts by weight of zinc oxide and 10 to 50 parts by weight of a filler.

6. The thread wound golf ball according to claim 1, wherein said rubber thread is prepared from a rubber composition comprising natural rubber and isoprene rubber in an amount ratio of 75:25 to 25:75 of natural rubber/isoprene rubber.

7. The thread wound golf ball according to claim 1, wherein said cover is composed of 100 parts by weight of transpolyisoprene resin, 3 to 20 parts by weight of natural rubber, 0 to 20 parts by weight of high-styrene resin, 2 to 15 parts by weight of zinc oxide and 5 to 25 parts by weight of titanium oxide.

8. The thread wound golf ball according to claim 1, wherein the liquid contained in said rubber bag comprises 100 parts by weight of water, 5 to 20 parts by weight of glycerin or ethylene glycol, 50 to 100 parts by weight of barium sulfate, and 10 to 30 parts by weight of clay, and wherein said rubber bag is prepared from a rubber composition comprising 100 parts by weight of natural rubber, 1 to 10 parts by weight of zinc oxide, and 10 to 50 parts by weight of a filler.

9. The thread wound golf ball according to claim 8, wherein said cover is composed of 100 parts by weight of transpolyisoprene resin, 3 to 20 parts by weight of natural rubber, 0 to 20 parts by weight of high-styrene resin, 2 to 15 parts by weight of zinc oxide, and 5 to 25 parts by weight of titanium oxide.

* * * * *

UNITED STATES PATENT AND TRADEMARK OFFICE

CERTIFICATE OF CORRECTION

PATENT NO. : 5,597,365

DATED : January 28, 1997

INVENTOR(S) : Mikio YAMADA et al.

It is certified that error appears in the above-indentified patent and that said Letters Patent is hereby corrected as shown below:

Column 7, Line 7 in Claim 1, change the incorrect term "$g \cdot m^2$" to correctly read --$g \cdot cm^2$--.

Signed and Sealed this

Fourteenth Day of October, 1997

*Attest:*

*Attesting Officer*

BRUCE LEHMAN

*Commissioner of Patents and Trademarks*